United States Patent [19]

Yasuda et al.

[11] Patent Number: 4,897,034

[45] Date of Patent: Jan. 30, 1990

[54] TRUCKS FOR USE IN TUNNEL KILNS

[75] Inventors: Keiji Yasuda, Aichi; Kazuhiro Miyahara, Nagoya, both of Japan

[73] Assignee: NGK Insulators, Ltd., Nagoya, Japan

[21] Appl. No.: 153,923

[22] Filed: Feb. 9, 1988

[30] Foreign Application Priority Data

Feb. 14, 1987 [JP] Japan ..... 62-19423[U]

[51] Int. Cl.[4] ..... F27D 3/12

[52] U.S. Cl. ..... 432/241; 432/137; 432/253

[58] Field of Search ..... 432/137, 241, 253

[56] References Cited

U.S. PATENT DOCUMENTS 1,862,548 6/1932 Prouty et al. .
4,615,676 10/1986 Corato ..... 432/137
4,721,459 1/1988 Fitz ..... 432/253

FOREIGN PATENT DOCUMENTS 3343909 6/1985 Fed. Rep. of Germany .
886524 1/1962 United Kingdom .

*Primary Examiner*—Henry C. Yuen
*Attorney, Agent, or Firm*—Arnold, White & Durkee

[57] ABSTRACT

A truck for use in a tunnel kiln is disclosed. The tunnel kiln is used for firing shaped bodies by heating them with use of a plurality of combustion burners provided on sides inside the tunnel kiln. The truck comprises supports. Among them, at least supports with which a combustion stream from the combustion burners directly contacts have a streamlined shape with respect to the combustion stream. By so constructing, turbulence of the combustion stream can be minimized to make temperature distribution more uniform inside the kiln.

4 Claims, 4 Drawing Sheets

TRUCKS FOR USE IN TUNNEL KILNS

BACKGROUND OF THE INVENTION (1) Field of the Invention:

The present invention relates to trucks suitably used for tunnel kilns.

(2) Related Art Statement:

As shown by way of example in FIG. 5, in a tunnel kiln which fires ceramic shaped bodies by burners provided at sides in a tunnel kiln (hereinafter referred to as 'under firing system'), combustion burners 13-1 and 13-2 are provided opposed to each other at lower portions of kiln walls 12 of the tunnel kiln 11 so that shaped bodies 14 are fired by heating the kiln inside with their combustion streams. That is, the shaped bodies 14 are placed on a truck movable in the kiln via supports 16. The opposed combustion burners 13-1 and 13-2 are ignited and their combustion streams are led to a combustion space 17 defined by the supports 16, whereby the shaped bodies 14 are fired from the underside.

Further, as shown in FIG. 7, combustion burners 13-1 and 13-4 may be arranged at upper and lower portions of kiln walls 12 of the tunnel kiln so that combustion chambers 17 are formed above and under the shaped bodies, and shaped bodies may be plied in two stages by shelf plates 18 and the supports 16, and fired in the kiln. When the shaped bodies are fired by this technique, it is also known that a surrounding gas around the shaped bodies is circulated by combustion streams from the upper and lower opposed burners so that a temperature distribution in the kiln is improved.

As shown sectionally and perspectively in FIGS. 6(*a*) and (*b*), respectively, supports 16 having a rectangular section have formerly been used on the above truck 15. Therefore, the combustion streams directly impinge upon the supports 16 having the rectangular section in front of the combustion burners 13-1 and 13-2 when the shaped bodies are being moved in the tunnel kiln 11 by the truck 15. As a result, the combustion streams are blown up along the truck without being burned inside the combustion chamber above the truck, and the combustion stream directly contacts with the shaped bodies. Consequently, the shaped bodies may be melted, or cut, deformed or color-changed due to nonuniform firing shrinkage of the shaped bodies at high temperatures.

On the other hand, the construction which has the upper and lower combustion burners as shown in FIG. 7 possesses a shortcoming in that the circulating effect around the shaped bodies weakens and the temperature distribution becomes nonuniform among the upper and lower portions of the tunnel kilns.

SUMMARY OF THE INVENTION

It is an object of the present invention to obviate the above-mentioned problems, and to provide trucks having supports for use in tunnel kilns, which supports have a streamlined shape with respect to combustion streams inside a kiln even when firing and consequently not causing shaped bodies to melt, cut, deform, or change color.

The trucks according to the present invention are used in a tunnel kiln to fire shaped bodies by heating them with a plurality of combustion burners provided on sides in the tunnel kiln, and are characterized in that at least supports with which combustion streams from the combustion burners directly contact are formed in a streamlined shape with respect to the combustion stream.

In the above construction, since the supports at the combustion burners with which the combustion streams contact are formed in the streamlined shape with respect to the combustion stream, turbulence of the combustion streams is minimized even when the supports come in front of the burners, so that the temperature distribution becomes uniform inside the kiln.

A truck in which all the supports are formed in a streamlined shape may be even more preferable than a truck in which only the supports of the truck with which the combustion streams directly contact are formed in the streamlined shape, because turbulence may occur even at supports with which the combustion stream does not directly contact.

Further, when the streamlined shape of the supports has an elliptical section with its substantially parallel portions being set in parallel with the combustion stream, resistance against the combustion stream is minimized. Thus, such a shape is preferable because of its smaller turbulence of the combustion stream.

These and other objects, features, and advantages of the present invention will be appreciated upon reading the following description of the invention when taken in conjunction with the attached drawings, with the understanding that some modifications, variations and changes of the same could be made by the skilled person in the art to which the invention pertains without departing from the spirit of the invention or the scope of claims appended hereto.

BRIEF DESCRIPTION OF THE DRAWINGS

For a better understanding of the invention, reference is made to the attached drawings, wherein.

Detailed description of the Invention

Figure 1A:
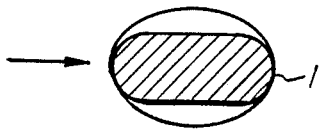
FIGS. 1(*a*) through 4(*a*) and FIGS. 1(*b*) through 4(*b*) are sectional views and perspective views of embodiments of the support structure for trucks according to the present invention, respectively.
Figure 1B:
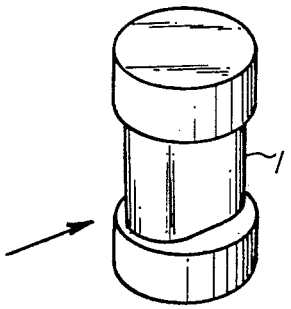
Figure 2A:
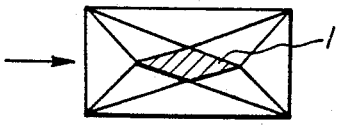
Figure 2B:
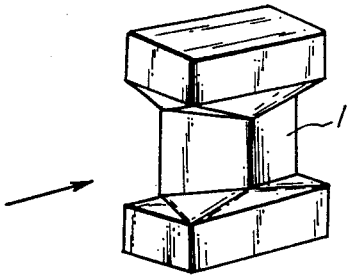
Figure 3A:
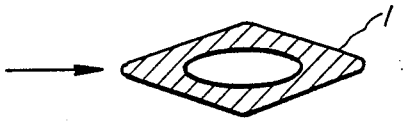
Figure 3B:
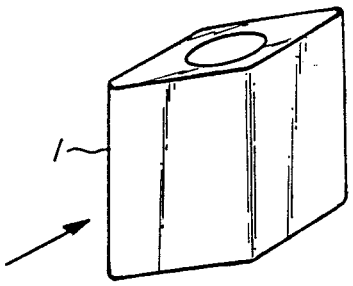
Figure 4A:
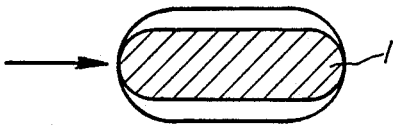
Figure 4B:
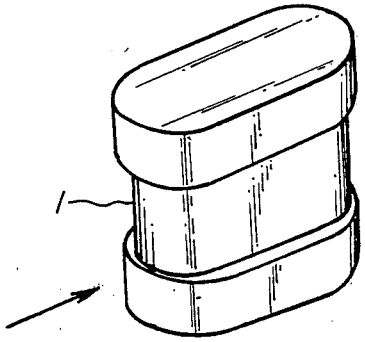
Figure 5:
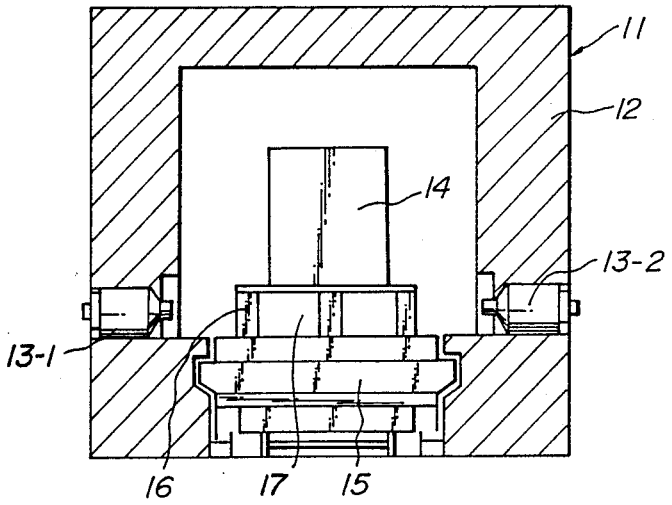
FIG 5 PRIOR ART
FIGS. 5 and 7 are views illustrating examples of tunnel kilns.

FIGS. 1(*a*) through 4(*a*) and FIGS. 1(*b*) through 4(*b*) are sectional views and perspective views of the structure of supports 1 of a truck for a tunnel kiln, respectively. FIGS. 1(*a*) and (*b*) show an embodiment having an elliptical section in which the section of a combustion stream-impinging portion shown by an arrow is formed in an elliptical shape with substantially parallel portions being short. FIGS. 2(*a*) and (*b*) show an embodiment in which a portion upon which a combustion stream impinges as shown by an arrow is formed in a rhombic section. FIGS. 3(*a*) and (*b*) show an embodiment in which the whole support is formed in a hollow rhombic shape, not only the portion upon which the combustion stream impinges. FIGS. 4(*a*) and (*b*) show in embodiment in which a portion upon which a combustion stream impinges as shown by an arrow is formed in an elliptical shape as in the embodiment of FIGS. 1(*a*) and (*b*), but the length of substantially parallel portions being longer than in the embodiment in FIGS. 1(*a*) and (*b*).

Figure 6A:
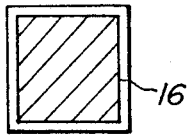
FIG 6a PRIOR ART
FIGS. 6(*a*) and (*b*) are a sectional view and a perspective view illustrating an example of a conventional support structure for trucks, respectively.
Figure 6B:
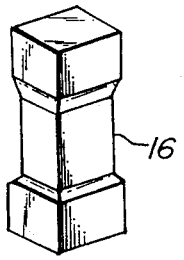
FIG 6b PRIOR ART
Figure 7:
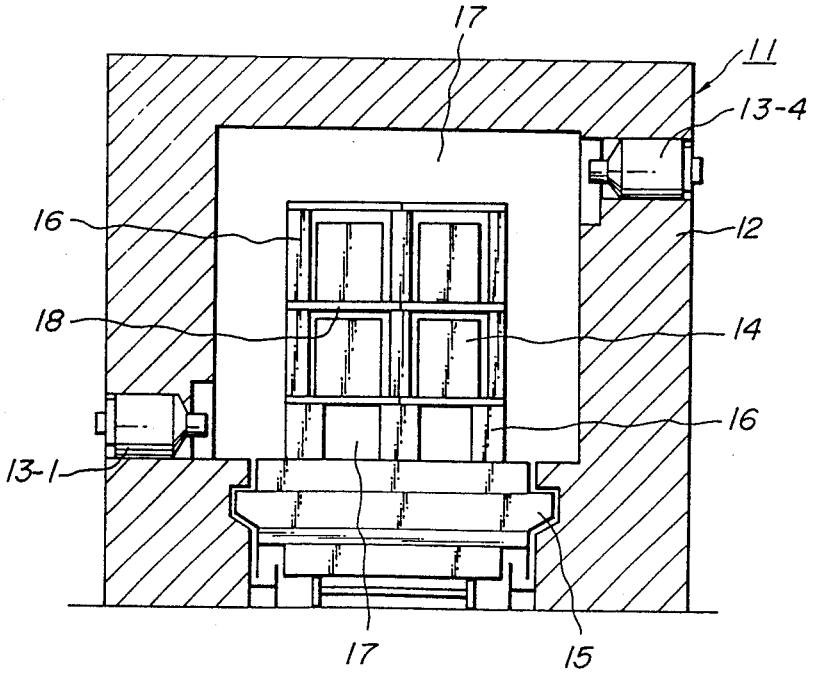
FIG 7 PRIOR ART

The above-mentioned supports 1 according to the present invention and the conventional support 16 shown sectionally and perspectively in FIGS. 6(*a*) and (*b*), respectively, were placed on a truck, and a gas was passed around the supports at a given velocity assuming an actual state inside the tunnel kiln. With respect to the respective supports, gas stream turbulence, gas velocity, gas inducing return percentage at burner opening, lower stage flow-restraining effect, and total evaluation were determined.

With respect to the gas stream turbulence, the gas stream near the support located in front of a combustion burner was observed when the gas was fed at a given velocity from the combustion burner, and evaluations were made by ○, Δ, and x which denote supports which allowed the gas to flow without causing turbulence or any substantial resistance, those which caused a little turbulence but its resistance being allowable, and those which caused great turbulence with large resistance, respectively.

The gas velocity was determined by measuring the velocity of the gas reaching a kiln wall when three supports were placed in front of a combustion burner in a width direction of the kiln and a gas was fed from the opposed combustion burner at a velocity of 12.0 m/s.

The gas inducing return percentage at burner opening was determined by the following equation.

$$\text{Return percentage } (\%) = \{B/(A-B\} \times 100$$

in which A and B are an amount of a gas blown out from the burner and an amount of the gas returned to the burner, respectively.

The lower stage flow-restraining effect is to examine an effect to restrain the flow in the kiln length direction, and was determined by measuring the velocity of the gas when the gas passed through the third support in the kiln length direction assuming that the gas velocity would be 5 m/s in the tunnel kiln.

Further, the total evaluations were made by ○ and Δ which denote supports which were improved with respect to all the turbulence of the gas flow, gas velocity, gas inducing return percentage at burner opening, and the lower stage flow-restraining effect, and supports in which the above characteristics were improved to some extent, respectively, as compared with the conventional technique. Results are shown in Table 1.

TABLE 1

| | Shape of support | Evaluated items: Turbulence of gas stream | Gas velocity (m/sec) | Gas return percentage at burner opening (%) | Lower stage flow-restraining effect (m/sec) | Total evaluation |
|---|---|---|---|---|---|---|
| Present invention | FIG. 1 | ○ | 1.2 | 52 | 0.6 | Δ |
| | FIG. 2 | Δ | 1.1 | 80 | 0.3 | Δ |
| | FIG. 3 | ○ | 1.0 | 64 | 0.2 | Δ |
| | FIG. 4 | ○ | 1.0 | 56 | 0.2 | ○ |
| Comparative Example | FIG. 6 | X | 0.4 | 70 | 0.6 | — |

As is clear from the results in Table 1, the supports according to the present invention having the shapes illustrated in FIGS. 1 through 4 had evaluation results equal to or better than the conventional support having a rectangular section in FIG. 6 with respect to any of the evaluation items. In particular, it was seen that the support having an elliptical section with substantially parallel portions being elongated had much better evaluation results than the conventional support.

As is clear from the above-detailed explanation, in the tunnel kiln trucks according to the present invention, the supports with which the combustion stream directly contact are formed in a streamlined shape with respect to the combustion stream. Thereby, turbulence of the combustion stream can be minimized so that the temperature distribution inside the kiln can be more uniform.

What is claimed is:

1. A truck for use in a tunnel kiln for firing shaped bodies by heating said shaped bodies with a plurality of combustion burners provided on sides inside said tunnel kiln, comprising supports, each of which has an elliptical cross section with substantially parallel portions thereof arranged in parallel to a combustion stream emitted from said combustion burners, such that each of said supports has a maximum cross sectional area substantially normal to said combustion stream which is smaller than the maximum cross sectional area substantially parallel to said combustion stream.

2. A truck according to claim 1, wherein said supports have first and second elliptical sections, said first section being larger than said second section.

3. A truck for use in a tunnel kiln for firing shaped bodies by heating said shaped bodies with a plurality of combustion burners provided on sides inside said tunnel kiln, comprising supports, each of which has a rhombic cross section, such that each of said supports has a maximum cross sectional area substantially normal to said combustion stream which is smaller than the maximum cross sectional area substantially parallel to said combustion stream.

4. A truck for use in a tunnel kiln for firing shaped bodies by heating said shaped bodies with a plurality of combustion burners provided on sides inside said tunnel kiln, comprising supports, each of which has a hollow rhombic cross section, such that each of said supports has a maximum cross sectional area substantially normal to said combustion stream which is smaller than the maximum cross sectional area substantially parallel to said combustion stream.

* * * * *